United States Patent [19]

Fujimoto

[11] Patent Number: 4,832,519

[45] Date of Patent: May 23, 1989

[54] SHEET SETTING DEVICE FOR PRINTER AND THE LIKE

[75] Inventor: Sakae Fujimoto, Tokyo, Japan

[73] Assignee: Ricoh Company, Ltd., Tokyo, Japan

[21] Appl. No.: 107,925

[22] Filed: Oct. 9, 1987

Related U.S. Application Data

[63] Continuation of Ser. No. 671,813, Nov. 15, 1984, abandoned, which is a continuation of Ser. No. 401,404, Jul. 23, 1982, abandoned.

[30] Foreign Application Priority Data

Jul. 24, 1981 [JP] Japan ..... 56-115353

[51] Int. Cl.[4] ..... B41J 13/20

[52] U.S. Cl. ..... 400/639.1; 400/631; 400/637.1

[58] Field of Search ..... 400/51, 550, 630, 631, 400/637.1, 639.1, 639.2

[56] References Cited

U.S. PATENT DOCUMENTS

| | | | |
|---|---|---|---|
| 847,428 | 3/1907 | McCormack | 400/631 |
| 945,893 | 1/1910 | Woodward | 400/631 |
| 1,270,292 | 6/1918 | Hess | 400/637.1 |
| 1,988,189 | 1/1935 | Dobson | 400/637.1 |
| 4,030,591 | 6/1977 | Martin et al. | 400/51 |
| 4,211,499 | 7/1980 | Hunt et al. | 400/639.1 X |
| 4,266,880 | 5/1981 | Buchanan | 400/639.1 X |
| 4,275,969 | 6/1981 | Matsuhisa et al. | 400/639.1 X |
| 4,486,108 | 12/1984 | Tanaka | 400/639.1 |
| 4,498,795 | 2/1985 | Tatara | 400/639.1 X |
| 4,569,611 | 2/1986 | Watanabe et al. | 400/639.1 X |

FOREIGN PATENT DOCUMENTS

| | | | |
|---|---|---|---|
| 0144983 | 11/1981 | Japan | 400/631 |
| 0075883 | 5/1982 | Japan | 400/639.1 |
| 0024682 | 2/1984 | Japan | 400/639.1 |

OTHER PUBLICATIONS

IBM Technical Disclosure Bulletin, "Automatic First Writing Line Mechanism", Sweat, Jr., vol. 23, No. 9, Feb. 1981, pp. 3961-3964.

Xerox Disclosure Journal, "Paper Bail Actuator", Kockler et al., vol. 4, No. 5, Sep./Oct. 1979, pp. 677-678.

*Primary Examiner*—Ernest T. Wright, Jr.

*Attorney, Agent, or Firm*—Cooper & Dunham

[57] ABSTRACT

A sheet setting device for a printer and the like including pressure rollers adapted to be brought into and out of engagement with a platen, and resist claws adapted to brought into and out of engagement with the platen in a position downstream of the position in which the pressure rollers are brought into and out of engagement with the platen. The device includes an operation lever and a linkage for linking the operation lever with the pressure rollers and the resist claws, the linkage being constructed such that as the operation lever is actuated, the resist claws are first brought into engagement with the platen and then the pressure rollers are moved away from the platen. By the aforesaid actuation of the operation lever, a lever having at its forward end paper ball rollers adapted to be brought into and out of engagement with the platen is moved through a cam in a manner to release the paper bail rollers from engagement with the platen. The aforesaid actuation of the operation lever is sensed by a switch which generates a signal for effecting control such that a carriage carrying a print head and a guide for guiding a sheet to conform to the outer peripheral surface of the platen is moved to a position suitable for guiding the sheet.

5 Claims, 7 Drawing Sheets

SHEET SETTING DEVICE FOR PRINTER AND THE LIKE

This is a continuation of application Ser. No. 671,813, filed Nov. 15, 1984, now abandoned, which is a continuation of application Ser. No. 401,404, filed July 23, 1982 (now abandoned).

FIELD OF THE INVENTION

This invention relates to a sheet setting device for a printer and the like.

DESCRIPTION OF THE PRIOR ART

Figure 1:
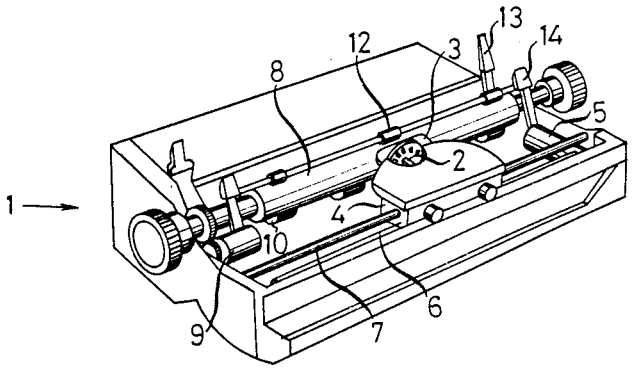
FIG. 1 PRIOR ART
FIG. 1 is a perspective view of a printer of the prior art, showing its construction.

FIG. 1 shows a printer in a schematic view in which the housing is removed. The printer generally designated by the numeral 1 comprises a carriage 4 supporting a printing head 2 and sheet guide means 3, the carriage 4 being moved by a carriage motor 5 through a cable 6 along a guide rail 7 extending transversely of the printer 1 to carry out printing on a sheet 8*a* (shown in FIG. 2), wound on a platen 8 prevented from moving axially. To enable the sheet 8*a* to be wound on the platen 8 in intimate contact therewith and fed accurately without being displaced from the platen 8 driven for rotation by a sheet feed motor 9, the sheet 8*a* wound on the platen 8 is pressed, as shown in FIG. 2, against the platen 8 by pairs of front pressure rollers 10 and rear pressure rollers 11 on a portion of the sheet 8*a* in which printing is not yet performed and by paper bail rollers 12 on a portion of the sheet 8*a* in which printing has already been performed.

Figure 2:
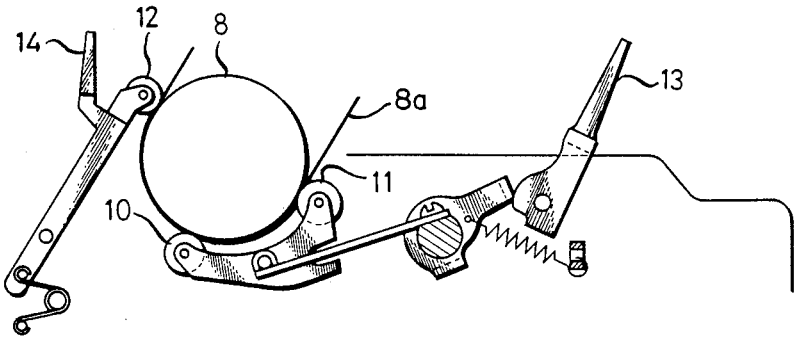
FIG. 2 PRIOR ART
FIG. 2 is a fragmentary sectional view of the printer shown in FIG. 1, showing the manner in which the rollers are located around the platen.

When a sheet 8*a* is set in the printer 1 of the aforesaid construction, it has hitherto been the usual practice for the operator to manipulate levers 13 and 14 mounted separately for the pressure rollers 10 and 11 and the paper bail rollers 12 respectively as shown in FIGS. 1 and 2 to move these aforementioned rollers 10, 11, 12 away from the platen 8, to insert a sheet 8*a*. After the sheet 8*a* is correctly positioned by effecting adjustments manually, the levers 13 and 14 are again manipulated to fix the sheet 8*a* in position with respect to the platen 8. This operation has been time-consuming and troublesome.

U.S. Pat. No. 4,266,880 discloses a device comprising a sensor in the form of a switch for sensing whether the paper bail actuating lever is in the paper bail operative position or paper bail inoperative position. When the paper bail is in an inoperative position in which it is spaced apart from the platen, a signal is produced by the sensor to rotate the platen while the pressure rollers are in pressing engagement therewith to feed the sheet to a printing initiation position. This device eliminates the need for the operator to perform positioning and skew correction manually, thereby considerably diminishing the trouble involved in sheet setting. However, it is not possible for the device to effect positioning with a high degree of accuracy because positioning is effected by means of pressure rollers. Thus, there is the disadvantage that in the event a sheet is skewed when inserted, it is necessary to release the pressure rollers from pressing engagement with the platen and correct skewing manually before the pressure rollers are again brought into pressing engagement with the platen.

When the skew correcting operation is being performed as aforesaid, a drive source for sheet feeding may be rendered operative as the paper bail is rendered inoperative or moved away from the platen. This might interfere with necessary operations. Also, when moving the paper bail away from the platen, the sheet is set by setting the desired printing initiating position in a single operation with the paper bail and platen in this relation. This might cause sheet jamming to occur, when the distance covered by the movement of the sheet is great in feeding the sheet, because the leading end of the sheet might come into contact with the inner surface of the cover without extending along the surface of the platen.

To obviate these disadvantages, a device has been developed in which the paper bail has three self-holding positions. In a first position, the paper bail is spaced apart from the platen and the sheet feeding motor is actuated to feed the sheet and move same a predetermined distance to a position in which the leading end of the sheet is held by the paper bail. In a second position, the paper bail is in contact with the platen and presses the leading end of the sheet fed as aforesaid against the platen, so that the sheet can be fed to a printing initiating position by the sheet feeding motor. In a third position, the paper bail is located midway between the first and second positions and spaced apart from the platen while the pressure rollers are also spaced apart from the platen to enable the operator to manually effect skew correction by rendering the sheet feeding motor inoperative.

By using this device, it is possible to carry out sheet setting and feeding in two steps by switching the position of the paper bail between the first and second positions, to move the sheet along the surface of the platen to a desired position in good condition. By moving the paper bail to the third position, it is possible to effect skew correction readily and safely.

In this device, switching of the paper bail between the three positions is effected by manipulating the paper bail handle. In the first and second positions, the paper bail is kept stationary by pressing the paper bail or a lever thereof against the stopper or platen by the biasing forces of toggle springs. In the third position, the paper bail is kept stationary by fitting the lower end of the paper bail holding lever in a recess formed in a resilient member whereby a detent is engaged. The sheet feeding motor is rendered operative and inoperative and the pressure rollers are brought into and out of engagement with the platen by a signal produced by a switch actuated by the displacement of the paper bail lever. The device of this construction has the disadvantage that when the hand or other part of the body of the operator is inadvertently brought into contact with the paper bail, paper bail shaft or paper bail handle while the paper bail is in the third position, the paper bail would be moved unintentionally to the second position and the sheet feeding motor would be rendered operative, thereby interfering with the skew correcting operation.

SUMMARY OF THE INVENTION

This invention has been developed for the purpose of obviating the disadvantages of the printer or typewriter of the type described above. Accordingly the invention has as its object the providing of a sheet setting device for a printer and the like of simple construction enabling a sheet to be semiautomatically set in the device by a simple manipulation of the mechanism.

The aforesaid object is accomplished according to the invention by providing a sheet setting device for a printer of the type having a platen adapted to be driven for rotation by a sheet feeding roller, pressure rollers and paper bail rollers adapted to be moved into and out of engagement with the platen, and resist claws each having a forward end capable of coming into and out of engagement with the platen in a position slightly downstream of the position in which the pressure rollers are brought into engagement with the platen. The sheet setting device includes an operation lever, and a linkage connecting the operation lever to the pressure rollers and the resist claws, the linkage being operative upon manipulation of the operation lever to first bring the resist claws into engagement with the platen and then release the pressure rollers from engagement with the platen. The aforesaid object can be better accomplished by providing a cam moved by manipulation of the operation lever, which cam is in engagement with a paper bail lever supporting the paper bail rollers at its forward end and is adapted to bring the paper bail rollers out of engagement with the platen by causing the paper bail lever to be moved by manipulation of the operation lever. More advantageously, a switch may be provided which is actuated by the displacement of a link of the linkage or the movement of the operation lever, so that when the switch produces a signal upon sensing the manipulation of the operation lever, the carriage can be moved to a position suiting the guiding of the sheet.

DETAILED DESCRIPTION OF THE PREFERRED EMBODIMENT

One embodiment of the invention will be described by referring to the accompanying drawing.

Figure 3:
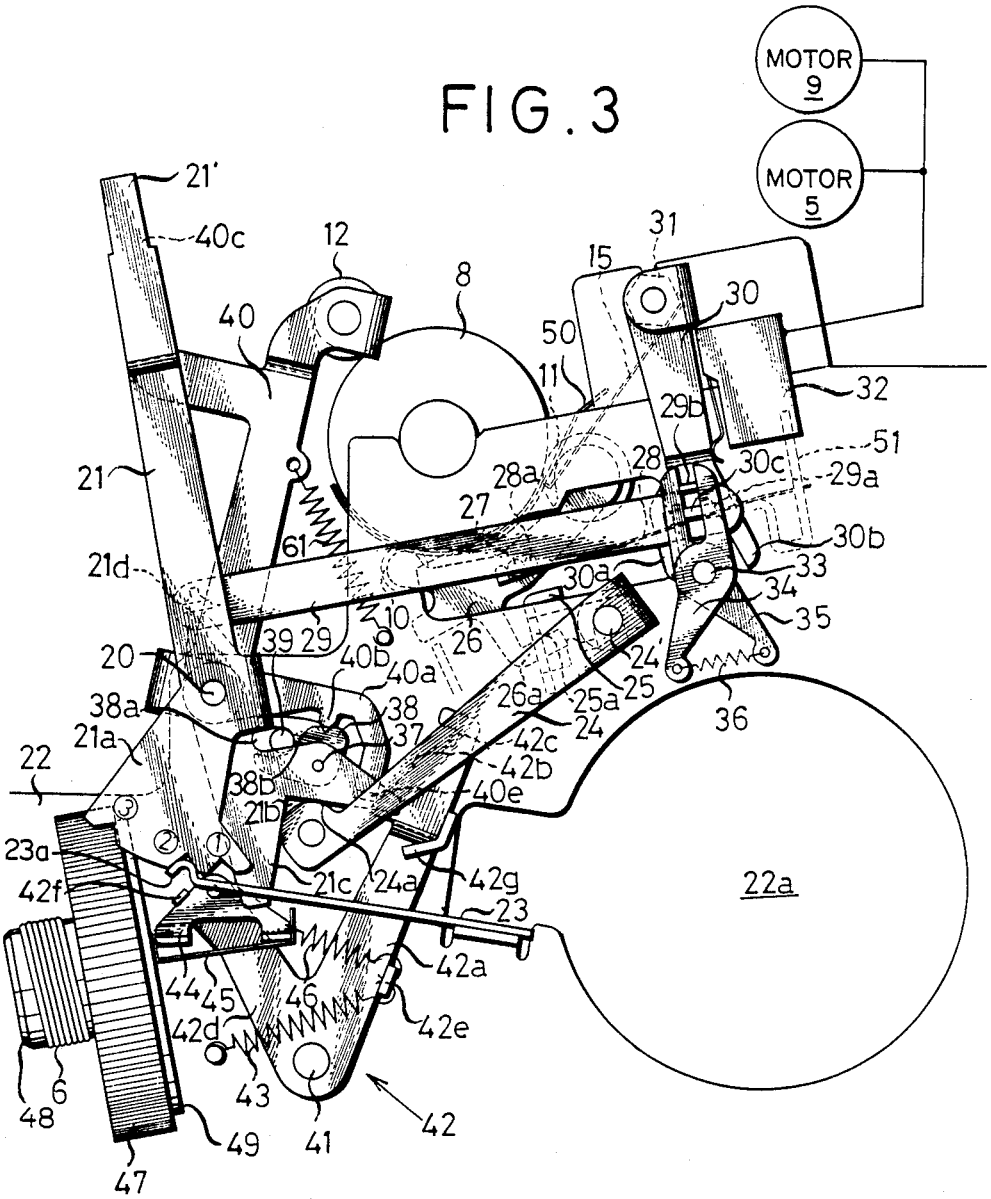
FIG. 3 is a side view of the sheet setting device comprising one embodiment of the invention, showing the conditions of the device before and after setting of a sheet.
Figure 4:
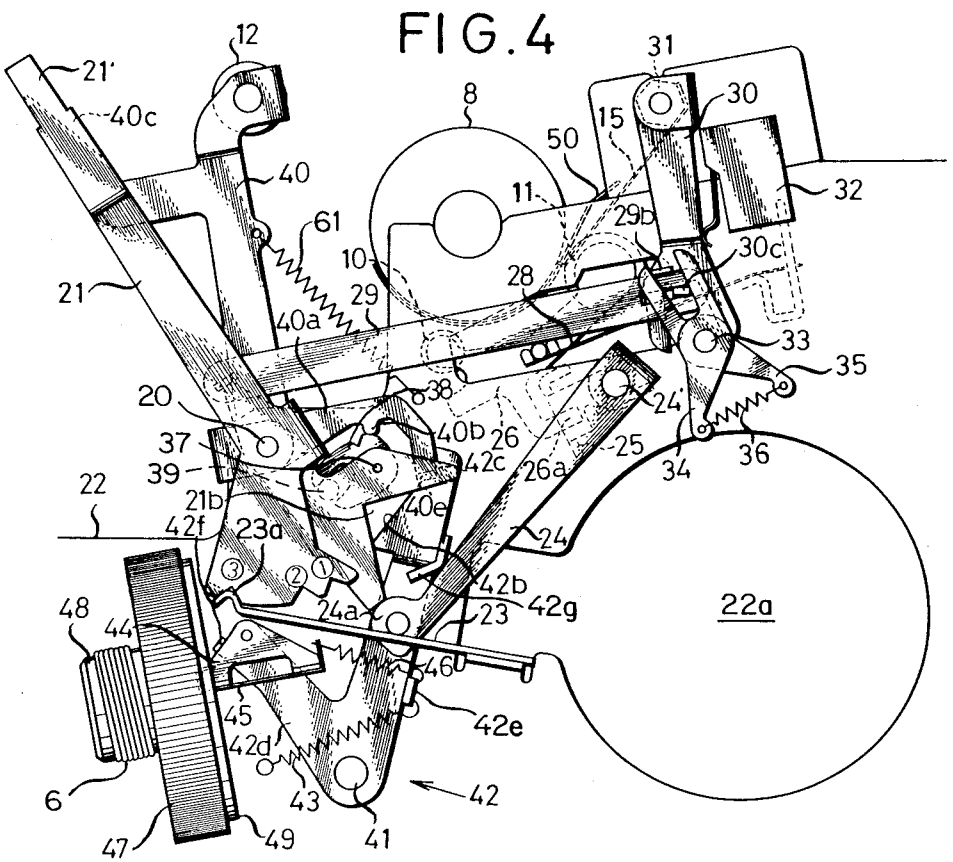
FIG. 4 is a view similar to FIG. 3 but showing the device in a condition intermediate between the conditions shown in FIG. 3.
Figure 5:
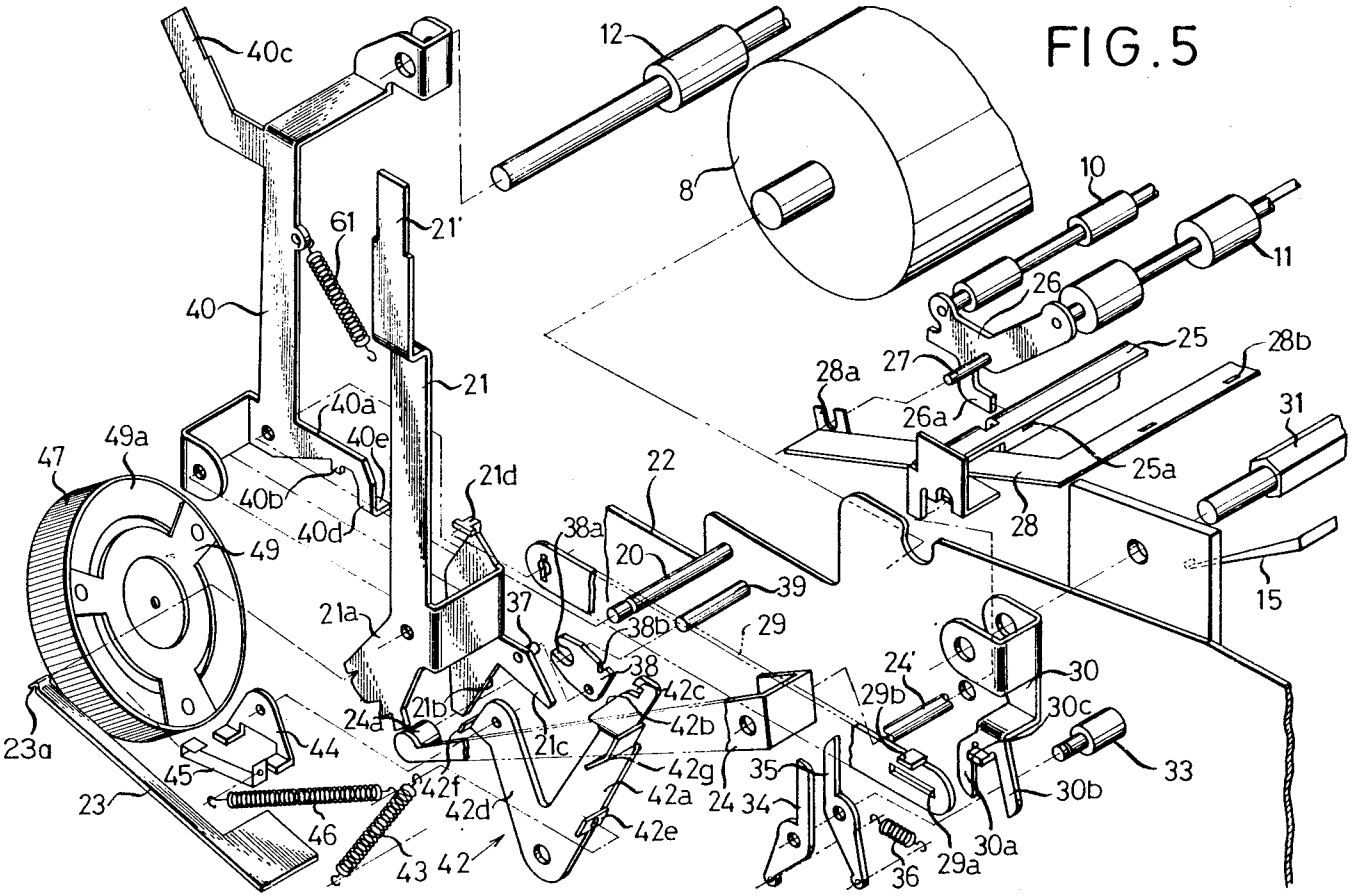
FIG. 5 is an exploded perspective view of the device shown in FIG. 3.

FIGS. 3, 4 and 5 are views showing the linkage for moving the pressure rollers and the resist claws by manipulation of the operation lever and the cam mechanism for moving the paper bail rollers. FIG. 3 is a side view of the device, showing the parts before and after setting of a sheet. FIG. 4 is a view similar to FIG. 3 but showing the parts in a condition before sheet setting following manipulation of the operation lever, and FIG. 5 is an exploded perspective view of the device.

As shown, a single operation lever 21 manipulated for semiautomatic setting of a sheet 8*a* is supported on a shaft 20 mounted on a side plate 22 and has a handle 21' at its upper end and a ginkgo-leaf-shaped portion 21*a* below a point at which the shaft 20 is supported. The ginkgo-leaf-shaped portion 21*a* has notches (1), (2) and (3) at the lower edge of an arcuate shape arranged from right to left. A projection 23*a* formed at one end of a plate spring 23 (secured at the other end to one part of a circular aperture 22*a* formed in side plate 22) is adapted to come into engagement with these notches (1), (2), (3) to thereby hold the lever 21 in a selected position. The lever 21 has at its lower end portion and in parallel with the ginkgo-leaf-shaped portion 21*a* a portion 21*c* having a large L-shaped cutout 21*b* which is in engagement with an engaging portion 24*a* at the free end of the pressure roller actuating lever 24 secured to a pressure roller actuating shaft 24' mounted on the side plate 22. Fixed to a portion of the pressure roller actuating shaft 24' disposed inwardly of the side plate 22 is a pressure roller elevating member 25 having formed at its front surface (left side of the figure) an aperture 25*a* in which is engaged with suitable play a hook-shaped portion of a projection 26*a* extending in the form of a letter L from the lower edge of a holding arm 26 for holding the pressure rollers 10 and 11. Besides being in engagement with the member 25 as aforesaid, the pressure roller holding arm 26 has a pin 27 attached to its side which pin 27 is supported by a support portion 28*a* at the forward end of a plate spring 28 so that the pin 27 is urged to move upwardly by the biasing force of the plate spring 28.

Figure 8:
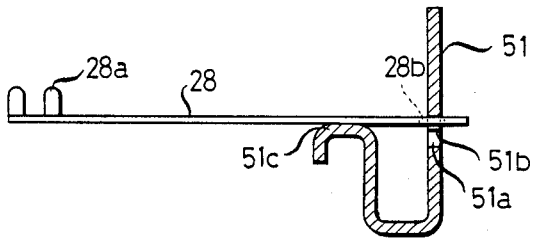
FIG. 8 is a sectional view showing one example of the manner in which the pressure roller pressing plate spring is supported.
Figure 9:
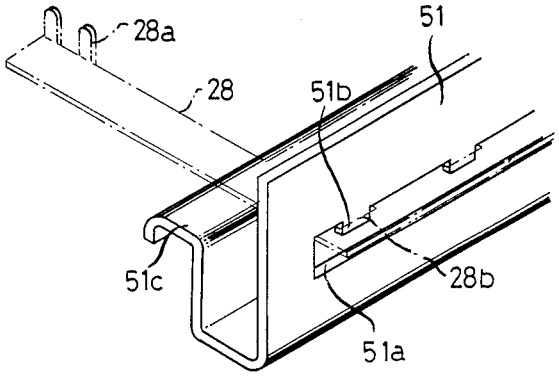
FIG. 9 is a perspective view of the pressure roller pressing plate spring shown in FIG. 8 in the intermediate condition.

The plate spring 28 has its rear portion supported as shown in FIGS. 8 and 9. The plate spring 28 has formed at its rear portion locking apertures 28*b* each adapted to receive therein one of projections 51*b* downwardly extending from the upper edge of a slit 51*a* formed in a stationary member 51. The latter is in the form of a letter J secured to the side plate 22 so that the undersurface of the plate spring 28 can be supported by the support portion 51*c* of the stationary member 51 in front of the projections 51*b*. This construction is simple and easy to assemble.

As aforesaid, the roller elevating member 25 is directly in engagement with the roller holding arm 26, and the plate spring 28 for imparting a pressing force to the pressure rollers 10 and 11 is supported by the stationary member 51 to regulate the pressing force. Thus the biasing force of the plate spring 28 providing the pressing force can be decided by a small number of parts, thereby reducing variations in the pressing force and enabling sheet feeding to be effected with minimized skewing.

The operation lever 21 has another shaft 21*d* located above the shaft 20 in the portion 21*c* for supporting one end of a connecting rod 29 extending substantially horizontally. The connecting rod 29 has formed in the other end portion a slot 29*a* extending axially to receive a projection 30*c* extending forwardly from between legs 30*a* and 30*b* formed at a bifurcated portion in the lower portion of a resist claw actuating lever 30. The resist claw actuating lever 30 is supported at its upper end by the side plate 22 and secured to one end of a resist claw shaft 31 of a hexagonal cross section.

Figure 10:
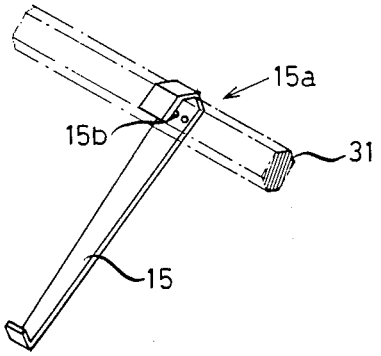
FIG. 10 is a perspective view of the resist claw, showing the manner in which the resist claw is mounted.

As shown in FIG. 10, the resist claw 15 has a mounting end portion bent to form a hook portion 15*a* shaped to conform to the resist claw shaft 31 to be able to hold onto it. Formed at one of opposite surfaces from the hooked portion 15*a* are a plurality of small apertures 15*b* which are adapted to receive projections (not shown) formed on the resist claw shaft 31 in corresponding positions. The resist claw shaft 31 is held in the hooked portion 15*a* of the resist claw 15 by spreading the hooked portion 15*a* within the limit of its elasticity. By the aforesaid arrangement, the resist claw 15 can be secured to the shaft 31 positively with a high degree of accuracy. It is to be understood that the resist claw shaft 31 is not limited to the hexagonal cross section. When it has a rectangular cross section, one has only to shape the hooked portion 15*a* of the resist claw 15 at its mounting end portion in a manner to match the cross-sectional shape of the shaft 31, such as in the form of a letter U. In order to prevent a scratch on the surface of the platen 8, a resinous material such as Teflon is coated on the contact edge of the resist claw 15.

The resist claw actuating lever 30 is in contact with microswitch 32. The projection 30*c* of the resist claw actuating lever 30 has a forward end portion extending through the slot 29*a* of the connecting rod 29 to the opposite side and held between holding members 34 and 35. These are supported by a pin 33 attached to the side plate 22 and urged by the biasing force of a spring 36 connecting the lower ends thereof together so as to be able to act as a pair of scissors freely movable toward and away from each other. A tongue 29*b* at the upper edge of the connecting rod 29 is also held by the holding members 34 and 35.

The operation lever 21 has attached thereto as indicated in FIG. 3 a pin 37 which supports a cam 38 formed with a guide groove 38*a* in which is engaged a guide pin 39 secured to the side plate 22. A notch 38*b* is formed on the cam surface at the upper edge of the cam 38 and in engagement, when the operation lever 21 is in the position shown in FIG. 3, with a projection 40*b* formed on arm 40*a* extending rearwardly (rightwardly in the figure) of a point at which a paper bail lever 40 is supported by the shaft 20. A tension spring 61 is mounted between the paper bail lever 40 near the upper end thereof and the side plate 22 to urge the lever 40 to move clockwise at all times to force the paper bail rollers 12 supported at its upper end against the platen 8. The rollers 12 are held in position by the engagement between the notch 38*b* and the projection 40*b*. Depending on the shape of the cam surface of the cam 38 and the shape of the guide groove 38*a*, when the operation lever 21 is moved from the position of notch (2) shown in FIG. 3 to the position of notch (3) shown in FIG. 4, the cam 38 pushes the projection 40*b* of the paper bail lever 40 upwardly as shown in FIG. 4, to bring a handle 40*c* at the upper portion of the lever 40 to a position in which it overlaps the handle 21' of the operation lever 21 as viewed from the side.

The paper bail lever 40 has in its lower portion an arm 40*a* extending at its forward end portion in a curve like the trunk of an elephant and having a tongue 40*e* at its forward end 40*d*. The tongue 40*e* is in engagement with a cam surface 42*b* on the upper inner side of an arm 42*a* at the rear end (right side in the figure) of a V-shaped lever 42, which is urged to move counter clockwise by the biasing force of a spring 43 mounted on the side plate 22. The cam surface 42*b* has at its upper end a notch 42*c* which, in the condition shown in FIG. 4, receives the tongue 40*e* at the forward end 40*d* of the paper bail lever 40 to position the same in such a manner that they are positively brought into engagement with each other by the tendency of the lever 42 to move counter clockwise by virtue of the biasing force of the spring 43. Thus the paper bail rollers 12 can be held in a position away from the platen 8 because the engagement of the tongue 40*e* in the notch 42*c* is not released unless the V-shaped lever 42 is moved clockwise by some external force. The V-shaped lever 42 has another arm 42*d* supporting at its forward end portion a member 44 having a plate spring 45 attached to the rear end of the member 44. A weak spring 46 is mounted between the mounting portion of the plate spring 45 and the tongue 42*e* at the rear end of the lever 42. Attached to the forward end of the arm 42*d* of the V-shaped lever 42 is a tongue 42*f* bent at right angles in engagement with the front edge of the member 44 urged to move by the biasing force of the spring 46, to thereby prevent further clockwise pivotal movement of the member 44.

Mounted in a position facing the forward ends of the members 44 and 45 is a gear 47 driven for rotation by a carriage motor (shown at 5 in FIG. 1). The gear 47 has secured to its front surface (left side surface as shown) a cable drum 48 for winding the cable 6 to drive the carriage 4. The gear 47 has at its rear surface a disc 49 having three segmental cutouts 49*a* as shown in FIG. 5. When the tongue 40*e* at the forward end of the paper bail lever 40 is in engagement with the notch 42*c* of the V-shaped lever 42 as shown in FIG. 4, the members 44 and 45 have their forward end portions received in the segmental cutouts 49*a*. If the gear 47 is rotated to move the carriage 4 from left to right in FIG. 1 at this time, then the forward end portions of the members 44 and 45 are kicked from above by the radial edge of the cutout 49*a* in the disc 49, to allow the members 44 and 45 to be released from engagement with one of the cutouts 49*a* as the weak spring 46 is extended. Thus the forward end portions of the members 44 and 45 are successively introduced into the adjacent segmental cutouts 49*a* to prevent the V-shaped lever 42 from being displaced. However, if the gear 47 is rotated in a direction in which the carriage 4 is moved from right to left, then the forward end portions of the members 44 and 45 are kicked from below by the radial edge of the cutout 49*a*. Since the member 44 is prevented from rotating clockwise about its own axis by the tongue 42*f* of the V-shaped lever 42, the member 44 rotates clockwise about the shaft 41 with the V-shaped lever 42 as a unit. This releases the tongue 40*e* at the forward end of the paper bail lever 40 from engagement with the notch 42*c* at the forward end of the V-shaped lever 42, to allow the paper bail lever 40 to be moved clockwise by the biasing force of the spring 61. The tongue 40*e* at the forward end of the lever 40 moves in a sliding motion while pushing the cam surface 42*b* of the V-shaped lever 42 rightwardly, to thereby move the lever 42 clockwise by overcoming the biasing force of the spring 43 to the condition shown in FIG. 3.

Operation of semiautomatically setting a sheet in the printer by using the device of the aforesaid construction will now be described. Initially, all the parts are in the positions shown in FIG. 3, with the operation lever 21 being in the position of notch (2). Pressure rollers 10 and 11 and paper bail rollers 12 are in engagement with the platen 8, and the resist claws 15 are out of engagement with the platen 8. When the printer 1 is turned on, the carriage 4 is automatically brought back to its home position on the leftmost side of the printer 1.

The operator manipulates the operation handle 21' to shift the operation lever 21 from the position of notch (2) to the position of notch (3) as shown in FIG. 4. This moves the connecting rod 29 leftwardly, to move the projection 30*c* of the resist claw actuating lever 30 leftwardly through the tongue 29*b* on the upper edge of the connecting rod 29, holding member 35, spring 36 and holding member 34. This moves the resist claw actuating lever 30 clockwise with the hexagonal shaft 31 and resist claw 15 as a unit, to bring the resist claw 15 into engagement with the platen 8 at its front end. Upon the resist claw actuating lever 30 moving as aforesaid, the microswitch 32 in contact therewith is turned on, to drive by its signal the carriage motor 5 to rotate a predetermined amount to move the carriage 4 to a substantially central position of the sheet 8*a* suitable for guiding the sheet 8*a*.

As the operation lever 21 is shifted as aforesaid, the forward end portion 24*a* of the pressure roller actuating lever 24 engaging the large right-angled cutout 21*b* formed in the lever 21 is pushed by the lateral edge of the cutout 21*b* to move downwardly therealong to the position shown in FIG. 4. The pressure roller actuating lever 24 moves counter clockwise together with the shaft 24' and pressure roller elevating member 25. This moves the front side of the member 25 downwardly, and the aperture 25*a* formed in the member 25 receives the projection 26*a* at the lower end of the pressure roller holding arm 26, and moves the arm 26 downwardly against the biasing force of the plate spring 28, to thereby move the pressure rollers 10 and 11 out of engagement with the platen 8. With suitable play being provided between the aperture 25*a* and projection 26*a*, the pressure rollers 10 and 11 are not immediately moved away from the platen 8 when the pressure roller actuating lever 24 begins to move. Initiation of movement of the pressure rollers 10 and 11 has a slight time lag behind initiation of movement of the pressure roller actuating lever 24. The resist claw 15 undergoes elastic deformation after being brought into engagement with the platen 8. This enables the separation of the pressure rollers 10 and 11 from the platen 8 to take place later than the engagement of the resist claw 15 with the platen 8.

The aforesaid shift of the operation lever 21 moves the cam 38 to the position shown in FIG. 4 in which it pushes upwardly the projection 40*b* of the paper bail lever 40 and causes the lever 40 to move counter clockwise against the biasing force of the spring 61, to move the paper bail rollers 12 away from the platen 8. The aforesaid movement of the paper bail lever 40 causes the V-shaped lever 42 in engagement with the tongue 40*e* at the forward end of the lever 40 to move counter clockwise without being separated therefrom by the biasing force of the spring 43. This allows the tongue 40*e* to move in sliding movement along the cam surface 42*b* of the V-shaped lever 42 until it stops by being received in the notch 42*c* at its upper end. This causes the forward end portions of the members 44 and 45 supported at the forward end portion of the arm 42*d* at the front side of the V-shaped lever 42 to be received in one of the segmental cutouts 49*a* formed in the disc 49 attached to the rear surface of the gear 47. While the parts are in the aforesaid position, the carriage 4 is moved from its home position on the leftmost side to a position in the central portion of the printer 1, and the gear 47 rotates. As aforesaid, in the event that the forward ends of the members 44 and 45 are kicked from above by the radial edge of the segmental cutout 49*a*, the spring 46 is extended to allow the forward end portions to move from one segmental cutout 49*a* to another and retain the V-shaped lever 42.

The aforesaid operation of the various parts involved is performed as the operator moves the operation lever 21 from the position of notch (2) to the position of notch (3), and all the parts involved shift from the positions shown in FIG. 3 to the positions shown in FIG. 4 in a short period of time.

By inserting a sheet 8*a* , such as from a sheet feeder, along a sheet guide plate 50 when the parts are in the aforesaid positions, the leading end of the sheet 8*a* can be brought, by its own weight or by the feeding force of sheet feed rollers 11, into abutting engagement with the resist claw 15 positioned at its forward end in engagement with the platen 8, to thereby enable positioning and skew correction to be effected.

Then, as the operator returns the operation lever 21 from the position of notch (3) to the position of notch (2) by manipulating the handle 21', the pressure roller actuating lever 24 moves clockwise to bring the pressure rollers 10 and 11 into engagement with the platen 8 while the parts operate in reverse to the operation described hereinabove. The connecting rod 29 moves rightwardly and the tongue 29*b* secured thereto pushes the holding member 34, so that the projection 30*c* of the resist claw actuating lever 30 is pushed rightwardly through the pusher spring 36 and holding member 35, to thereby move the resist claw actuating lever 30 and hexagonal shaft 31 to move counter clockwise to move the resist claw 15 away from the platen 8. In reverse to the operation described hereinabove, initiation of the movement of the resist claw 15 away from the platen 8 slightly lags behind initiation of the engagement of the pressure rollers 10 and 11 with the platen 8.

The aforesaid movement of the operation lever 21 returns the cam 38 to the position shown in FIG. 3. However, the engagement of the tongue 40*e* at the forward end of the paper bail lever 40 with the notch 42*c* of the V-shaped lever 42 is not released due to the biasing forces of the springs 61 and 43, so that the paper bail lever 40 and V-shaped lever 42 remain in their positions shown in FIG. 4.

As the resist claw actuating lever 30 moves counter clockwise, the microswitch 32 in contact therewith is turned off and produces a signal which drives the sheet feed motor 9 (FIG. 1) to rotate a predetermined amount, to thereby rotate the platen 8 to feed by a predetermined amount the sheet 8*a* pressed at its leading end portion by the pressure rollers 11 against the platen 8. Thus the sheet 8*a* is brought to a printing initiating position, guided by the paper guide 3 of the carriage 4 located substantially in the central position of the sheet 8*a*, where it stops.

Upon the platen 8 being brought to a halt, the next control sequence is performed so that the carriage motor 5 rotates a predetermined amount in a direction in which the carriage 4 is moved from right to left to return it to its home position from the substantially central position in which the sheet 8*a* is guided by the paper guide 3. At this time, the gear 47 rotates in a direction opposite the direction of rotation in the operation described hereinabove and the forward ends of the members 44 and 45 are kicked from below by the radial edge of the segmental cutout 49*a* . This moves the V-shaped lever 42 clockwise and releases its notch 42*c* from engagement with the paper bail lever 40. The latter is moved clockwise by the biasing force of the spring 61 to bring the paper bail rollers 12 into pressing engagement with the sheet 8*a* on the platen 8. It is possible to lock the paper bail lever 40 (by tongue 40*e* and notch 42*c*) irrespective of the position in which the disc 49 is brought to a halt, since the plate spring member 45 is located in slightly-spaced-apart relation to the member 44.

Thus all the parts of the device are returned to their positions shown in FIG. 3 and the sheet 8*a* is held firmly on the platen 8 by the pressure rollers 10 and 11 and paper bail rollers 12. The sheet 8*a* is fed a predetermined amount from the position in which positioning and skew correction of the leading end of the sheet 8*a* are performed by the resist claw 15 to bring the sheet 8*a* accurately to the printing initiating position. With the carriage 4 having returned to its home position, a printing operation can be immediately begun.

Figure 6:
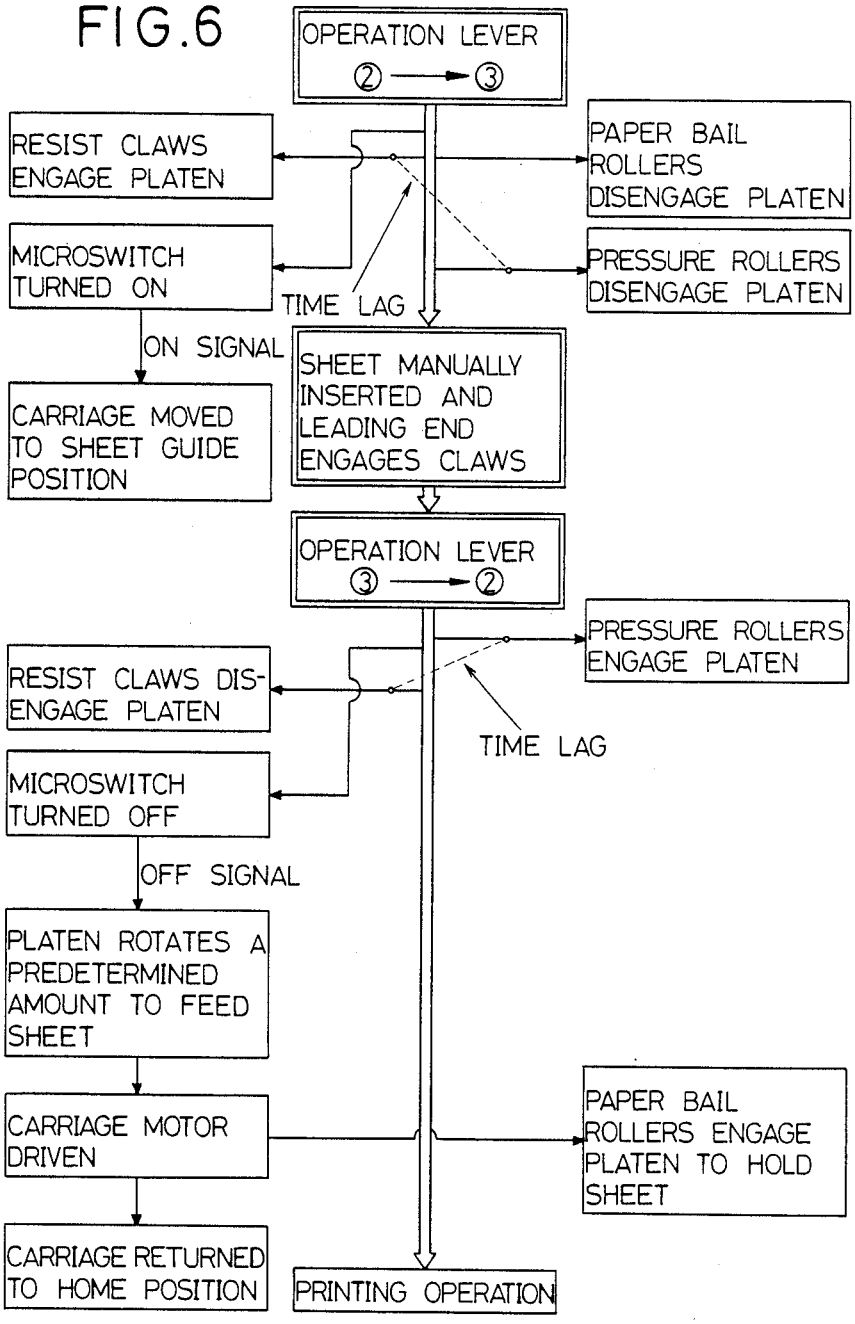
FIG. 6 is a flow chart showing the operation of semi-automatic sheet setting performed by using the embodiment of the sheet setting device in conformity with the invention shown in FIGS. 3–5.

FIG. 6 shows in a flow chart the principal operations of the parts involved in the semiautomatic sheet setting described hereinabove.

Figure 7:
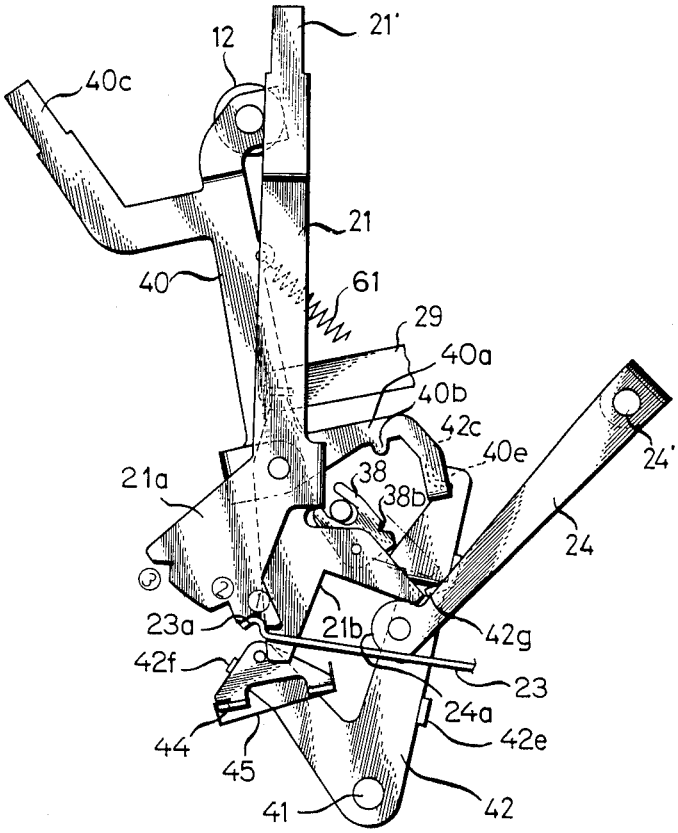
FIG. 7 is a side view of the device shown in FIG. 3, showing some elements of the device in an intermediate condition for performing manual insertion of a sheet.

The position of notch (1) of the operation lever 21 is used when it is necessary to finely position the sheet 8*a* after being set, for example, manually or when a sheet 8*a* is set automatically. In this case, it is necessary that the pressure rollers 10 and 11, paper bail rollers 12 and resist claw 15 be all moved away from the platen 8. When the handle 21' of the operation lever 21 is manipulated to move the lever 21 to the position of notch (1) from the position shown in FIG. 3, the forward end portion 24*a* of the pressure roller actuating lever 24 moves in sliding movement rearwardly along the upper edge of the cutout 21*b* of the lever 21 while being moved downwardly thereby, to a position shown in FIG. 7. The pressure roller actuating lever 24 moves counter clockwise to move the pressure rollers 10 and 11 away from the platen 8. As the leg of the cam 38 pushes the arm 40*a* of the paper bail lever 40 upwardly, the paper bail rollers 12 are slightly moved away from the platen 8. Meanwhile the connecting rod 29 moves rightwardly, but since the left leg 30*a* of the resist claw actuating lever 30 is positioned at its inner side against the pin 33 as shown in FIGS. 3 and 4, the resist claw actuating lever 30 is relieved through the slot 29*a* and prevented from moving although the spring 36 is extended. Thus the microswitch 32 remains inoperative and consequently the carriage motor 5 and platen motor 9 remain inoperative. If the operator pulls the handle 40*c* at the upper end of the paper bail lever 40 toward him, then the paper bail rollers 12 are further moved away from the platen 8, and the projection 40*e* at the forward end of the lever 40 moves in sliding movement along the cam surface 42*b* of the V-shaped lever 42 in pressing engagement therewith by the biasing force of the spring 43, to be received in the notch 42*c* at its upper end to be positioned therein and kept stationary by the springs 43 and 61. Thus the paper bail lever 40 is not returned to its original position even if the handle 40*c* is released or even if the hand or body is inadvertently brought into contact with the handle 40*c*. The position of notch (1) is a position in which the operation lever 21 is pushed forwardly to the utmost, so that the operation lever 21 does not shift to the position of notch (2) or notch (3) even if the hand or body is inadvertently brought into contact with the lever 21.

By the aforesaid operation, the pressure rollers 10 and 11, paper bail rollers 12 and resist claw 15 are all brought out of engagement with the platen 8 and the carriage motor 5 and platen motor 9 are both rendered inoperative. Thus it is possible to effect insertion of a sheet 8*a* either manually or automatically (as is conventionally known) and positioning thereof without any trouble.

Then the pressure roller actuating lever 24 is returned to the position shown in FIG. 3 is the handle 21' is manipulated by the operator to return the operation lever 21 to the position of notch (2), to thereby bring the pressure rollers 10 and 11 into engagement with the platen 8. When the forward end of the upper portion of the large cutout 21*b* of the lever 21 returns to a dash-and-dot line position shown in FIG. 7 (the condition similar to that shown in FIG. 3), it kicks rightwardly a tongue 42*g* located on the right side edge of the V-shaped lever 42 as shown to bring the notch 42*c* out of engagement with the tongue 40*e* of the paper bail lever 40, so that the paper bail lever 40 is pulled by the spring 61 to bring the paper bail rollers 12 into pressing engagement with the sheet 8*a* on the platen 8. Thus all the parts of the device are restored to the positions shown in FIG. 8, to be ready for initiation of a printing operation.

When a page feeder is used, the handle 21' is manipulated to move the operation lever 21 to the position of notch (1) to bring the paper bail rollers 12 and pressure rollers 10 and 11 away from the platen 8 a small distance.

From the foregoing description, it will be appreciated that the invention enables, by a simple mechanism, the printer to be brought to a position in which sheet setting can be performed in one operation of the handle of the operation lever in semiautomatic sheet setting operation, and allows positioning and skew correction of the sheet to be effected before being fed to a printing initiating position by returning the handle to its original position, thereby making it possible to start printing at once. Also, manual setting of a sheet can be readily effected by manipulating the operation lever and a paper bail actuating lever. Thus the invention contributes to an increase in the accuracy with which positioning of a sheet can be achieved and an improvement in operation efficiency in performing printing.

What is claimed is:

1. A printer comprising:

a platen (8), a first motor (9) for driving said platen (8) to rotate, a carriage (4) supporting a printing means (2) and a sheet guide means (3) which is movable along said platen (8), a second motor (5) for driving said carriage (4) to move along said platen (8), paper bail rollers (12) which are movable between a position in engagement with said platen (8) and a position out of engagement with said platen (8), wherein the improvement comprises:

a holding means (42) which holds said paper bail rollers (12) in the position out of engagement with said platen (8), means, including a sensing means (32) which senses the movement of said paper bail rollers (12), for generating a first signal to actuate said second motor (5) such that said carriage (4) is moved to a predetermined position along the platen (8) and for generating a second signal to successively actuate said first motor (9) and said second motor (5) such that the platen (8) is rotated to lead a sheet in the direction of a position between the platen (8) and the paper bail rollers (12) guided with said sheet guide means (3) and then said carriage (4) is driven in reverse direction, said first signal being generated when said sensing means (32) senses that said paper bail rollers move to the position out of engagement with said platen (8) and said second signal being generated thereafter, and means for releasing said paper bail rollers (12) from holding in said position out of engagement with said platen (8) by the rotation of the second motor (5) for driving said carriage (4) to move along said platen (8) in the reverse direction.

2. A printer as claimed in claim 1, further comprising a rotatable member (47) which transmits a moving force of the carriage, and wherein in the case when the carriage is driven in the reverse direction, said rotatable member (47) moves said holding means (42) to release said paper bail rollers (12) from holding in position out of engagement with the platen.

3. A printer as claimed in claim 1, wherein said holding means (42) is interposed between said paper bail rollers (12) and a rotatable member (47) which transmits a moving force of the carriage.

4. A printer comprising:

a platen (8), a first motor (9) for driving said platen (8) to rotate, a carriage (4) supporting a printing means (2) and a sheet guide means (3) which is movable along said platen (8), a second motor (5) for driving said carriage (4) to move along said platen (8), paper bail rollers (12) which are movable between a position in engagement with said platen (8) and a position out of engagement with said platen (8), means for generating a first signal to actuate said second motor (5) such that said carriage (4) is moved to a predetermined position along the platen (8) and thereafter generating a second signal to actuate said first motor (9) such that the platen (8) is rotated to lead the sheet in the direction of a position between the platen (8) and the paper bail rollers (12) guided with said sheet guide means (3), wherein the improvement resides in that the movement of the paper bail rollers between a position in engagement with said platen and a position out of engagement with said platen is controlled by the second motor (5) for driving said carriage (4) to move along said platen (8).

5. A printer as claimed in claim 4, wherein said paper bail rollers are movable also manually.

* * * * *